United States Patent [19]

Horiuchi et al.

[11] 4,290,908

[45] Sep. 22, 1981

[54] METHOD AND APPARATUS FOR TREATMENT OF RADIOACTIVE WASTES

[75] Inventors: Susumu Horiuchi, Hitachi; Takashi Taniguchi, Mito; Masaki Takeshima; Mikio Hirano, both of Hitachi; Hideo Yusa, Katsuta, all of Japan

[73] Assignee: Hitachi, Ltd., Tokyo, Japan

[21] Appl. No.: 55,151

[22] Filed: Jul. 6, 1979

[30] Foreign Application Priority Data

Jul. 19, 1978 [JP] Japan ..... 53-88657

[51] Int. Cl.[3] ..... G21F 5/00; G21F 7/06; G21F 9/00

[52] U.S. Cl. ..... 252/301.1 W; 34/77; 250/506; 250/507; 406/39; 406/109; 414/152; 414/154; 414/199; 414/222; 422/903

[58] Field of Search ..... 252/301.1 W; 406/39, 406/109; 34/77; 250/506, 507; 414/152, 154, 199, 222; 422/903

[56] References Cited

U.S. PATENT DOCUMENTS

| | | | |
|---|---|---|---|
| 3,155,431 | 11/1964 | Baldwin | 406/39 |
| 3,663,817 | 5/1972 | Sayers | 252/301.1 W |
| 4,134,216 | 1/1979 | Stevens | 34/77 |
| 4,197,467 | 4/1980 | Williams | 250/506 |

FOREIGN PATENT DOCUMENTS

| | | | |
|---|---|---|---|
| 2526424 | 12/1976 | Fed. Rep. of Germany | 250/507 |
| 52-34200 | 3/1977 | Japan | 252/301.1 W |
| 52-26319 | 7/1977 | Japan | 250/506 |

*Primary Examiner*—Deborah L. Kyle
*Attorney, Agent, or Firm*—Craig and Antonelli

[57] ABSTRACT

A radioactive waste discharged from a radioactive substance handling equipment is dried and powdered, and the powder is pelletized. The resulting pellets are stored in an inner vessel of a store vessel having a double structure for a predetermined period to attenuate the radioactivity of the pellets. Then, the pellets are taken out from the store vessel and packed into a sealing vessel. A binder is injected into the sealing vessel to effect solidification.

16 Claims, 14 Drawing Figures

METHOD AND APPARATUS FOR TREATMENT OF RADIOACTIVE WASTES

BACKGROUND OF THE INVENTION

1. Field of the Invention

The present invention relates to a method and apparatus for the treatment of radioactive wastes. More particularly, the invention relates to a method and apparatus for the treatment of radioactive wastes in which a temporary store tank which is maintained under predetermined atmosphere conditions is adopted for the temporary storage of pellets of a radioactive waste to attenuate the radioactivity of the waste and a binder such as asphalt or plastics is injected to effect solidification, whereby maximum reduction of the volume of the waste can be conveniently attained.

2. Description of the Prior Art

In atomic power plants, radioactive wastes discharged from, for example, a water boiler type reactor, are ordinarily packed and stored in a vessel having a shielding structure designed according to the dose rate of the radioactive wastes so as to reduce the dose thereof. If such radioactive waste is stored in the liquid state containing water, the necessary storage capacity becomes tremendous. Accordingly, the waste is stored after reduction of the volume by evaporation and solidification. It is regulated that the dose rate on the surface of the vessel should be lower than 200 mrem/hr and that the mechanical strength of the vessel should be at least 150 $Kg/cm^2$.

Conventional methods for the treatment of a radioactive waste water formed with the operation of a water boiler type reactor in an atomic power plant, which is composed mainly of sodium sulfate ($Na_2SO_4$), are disclosed in Japanese Patent Publications No. 37518/1978 and No. 37519/79. The first method comprises concentrating a radioactive waste water by a condenser, mixing the concentrate in a drum can with cement to effect solidification and storing the solidified waste in the drum can. The second method comprises concentrating a radioactive waste water by a condenser, mixing the concentrate and asphalt molten by heating, heating the mixture to evaporate water from the waste, packing the resulting mixture of asphalt and sodium sulfate in a drum can and cooling the packed mixture to effect solidification. In each method, as pointed out above, it is regulated that the dose rate on the surface of the drum can should be less than 200 mrem/hr and the mechanical strength (axial compression strength) should be at least 150 $Kg/cm^2$. In order to satisfy these requirements, the amount of the solidified waste after evaporation of the waste water is 28 Kg per drum can in the first method or 26.4 Kg per drum can in the second method. Furthermore, in the first method, the upper portion of the drum can is substantially occupied by the waste water and it is technically difficult to cover such waste water with cement. These two known methods have the following disadvantage in common. Namely, since a radioactive waste water produced is immediately solidified and stored, it is impossible to increase the pack ratio of the waste in a drum can because of the above-mentioned regulation of the dose rate. Thus, there has not yet been established a practical method or apparatus for treating radioactive wastes with safety.

SUMMARY OF THE INVENTION

It is therefore a primary object of the present invention to solve the foregoing problems involved in the conventional techniques and provide a method and apparatus for the treatment of radioactive wastes in which the amount formed of solids of radioactive wastes can be reduced by attenuation of the radioactivity of the wastes and the solidified wastes can be stored with ease and safety.

One of the characteristic features of the present invention is that a radioactive waste is granulated by drying and then pelletized, the pellets are stored in a temporary store vessel for attenuation of the radioactivity of the pellets, the pellets are taken out from the store vessel and packed in a sealing vessel and a binder is injected into the sealing vessel.

Another characteristic feature of the present invention is that in order to ensure the operation safety, the structure of the store vessel is specially arranged and a specific environment control system is adopted.

DETAILED DESCRIPTION OF THE PREFERRED EMBODIMENTS

The present invention will now be described in detail by reference preferred embodiments shown in the accompanying drawings, in which the present invention is applied to a water boiler type reactor.

Figure 1:
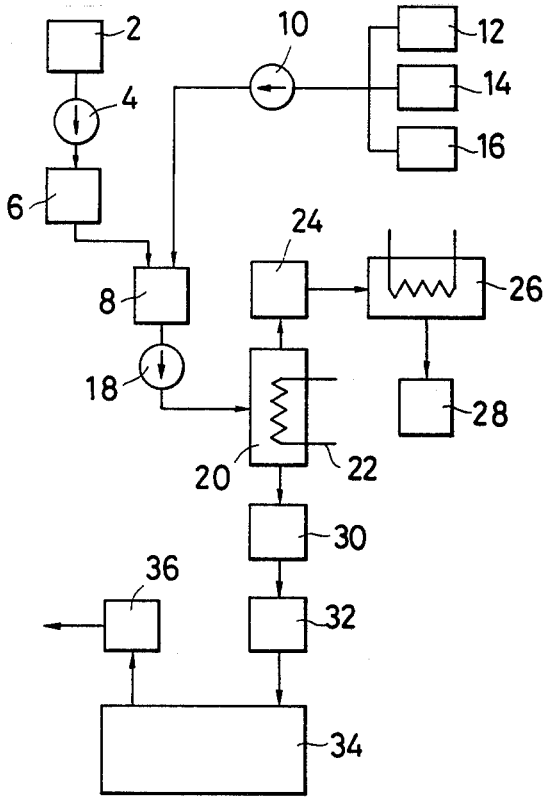
FIG. 1 is a block diagram illustrating the flow of the method for treating radioactive wastes according to the present invention.

Referring to FIG. 1 which is a block diagram illustrating one embodiment of the present invention, a radioactive waste water (a solution type waste water containing detergents, sodium sulfate, etc.) in a waste water receiving tank 2 is introduced into a condenser 6 by a waste water supply pump 4, and the concentrated waste water is then mixed to a mixing tank 8. A granular ion exchange resin slurry, a filter assistant slurry and an incinerator ash slurry are fed to the mixing tank 8 by a slurry feed pump 10 by slurry tanks 12, 14 and 16, respectively and they are mixed in the mixing tank 8 with the concentrated waste water extruded from the condenser 6. An agitator is disposed in the mixing tank 8 to mix the radioactive waste with the slurries to prevent sedimentation and deposition of the solids in the bottom of the mixing tank 8. The solid content is about 5% by weight in the slurries fed from the slurry tanks 12 ,14 and 16. The liquid mixture in the mixing tank 8 is fed to a centrifugal film drier 20 by a liquid mixture feed pump 18 and is heated by a heating tube 22 in the drier 20. Vapors generated by heating in the centrifugal film drier 20 are introduced into a decontamination column 24 where entrained particles are removed, and the vapors are then condensed by a condenser 26. Water formed by condensation is fed to a receiving tank 28. The solids in the liquid mixture are powdered by rotation of a rotation shaft provided with rotary blades in the centrifugal film drier 20. The powder is formed into solid pellets having a predetermined shape by a granulator 30, and the pellets are fed to a store vessel 34 by a pellet transporting device 32. The store vessel 34 is composed of concrete coated with a metal lining and predetermined atmosphere conditions are maintained in the store vessel 34. The pellets are held up in the store vessel 34 for a predetermined period to attenuate the radioactivity of the pellets. After the radioactivity has been sufficiently attenuated, the pellets are taken out from the store vessel 34 by a pellet treating device and are then charged in a vessel (not shown). A binder such as asphalt or plastics is injected in this vessel and the vessel is sealed. Finally, the waste is discharged to the natural world in the form of solids.

Figure 2:
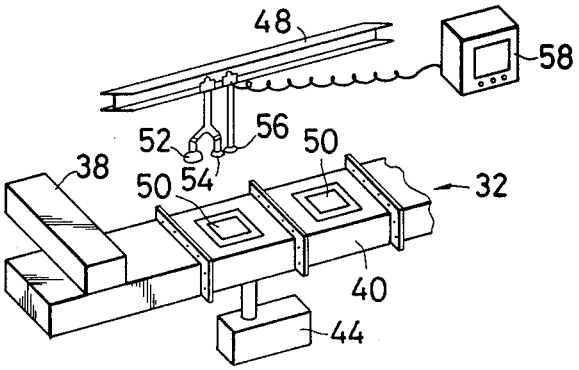
FIG. 2 is a perspective view showing a pellet transporting device and an inspection system.
Figure 3:
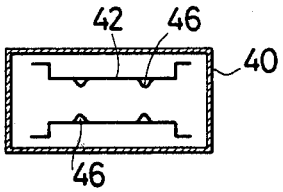
FIG. 3 is a view illustrating the section of a duct of the pellet transportig method.
Figure 4:
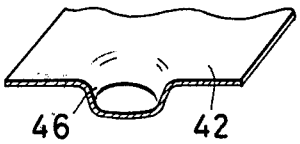
FIG. 4 is a perspective view showing the state where pellets are stored in pocket portions formed on a conveyor in the duct.

The pellet transporting device shown in FIG. 1 will now be described by reference to FIGS. 2 through 4.

Pellets formed by the granulator 30 are fed into the pellet transporting device 32 from a pellet feed device 38. The pellet transporting device 32 includes a duct 40 and a conveyor 42 carrying pellets thereon in the duct 40 as shown in FIG. 3. The pressure, temperature and humidity in the conveyor 42 of the pellet transporting device 32 are controlled to optimum levels by a control device 44. Pocket portions 46 for receiving pellets are disposed in the conveyor 42 as shown in FIGS. 3 and 4. By disposition of these pocket portions 46, it is possible to maintain the surface dose of the pellet transporting device 32 within an allowable dose range. More specifically, pellets are inevitably fed into the pocket portions 46 of the conveyor 42 by the pellet feed device 38 so that one pellet is received by one pocket portion 46. Accordingly, the number of pellets in the pellet transporting device 32 can be adjusted to a predetermined number, and therefore, the surface dose of the pellet transporting device 32 can be maintained within a predetermined range. In order to maintain safety, these pocket portions 46 are arranged so that one pellet is received in one pocket portion, and in order to prevent pellets from falling out of the pocket portions 46 during the transportation, the size of the pocket portions 46 is made larger than the size of the pellets and the depth of the pocket portions 46 is about 1.5 times the thickness of the pellets.

The pellets being transported in the pellet transporting device 32 are always watched by a television camera 52 moving on the duct 40 and a window 50 formed on the duct 40 along a mono-rail 48, and an illuminating lamp 54 and a radiation detector 56. When occurrence of a trouble such as deliquescence of pellets or disorder of the machine is detected by a television 58, the pellet feed device 38 and pellet transporting device 32 are stopped for inspection and checking.

By using the above-mentioned pellet transporting device 32, the transportation of the pellets to the store vessel 34 for attenuating the radioactivity can be performed stably without such trouble as deliquenscence or disorder of the machine. Furthermore, the surface dose of the pellet transporting device 32 can be controlled below the regulated level and the maintenance of the pellet transporting device 32 can be remarkably facilitated. Moreover, local concentration of the radioactive pellets in the pellet transporting device 32 can be detected and therefore, occurrence of a serious trouble can be prevented.

The structure of the store vessel 34 will now be described in detail by reference to FIGS. 5 and 6.

Figure 6:
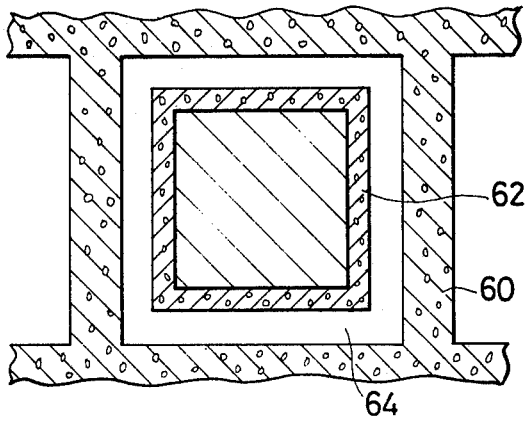
FIG. 6 is a view showing the section taken along the line VI—VI in FIG. 5.
Figure 5:
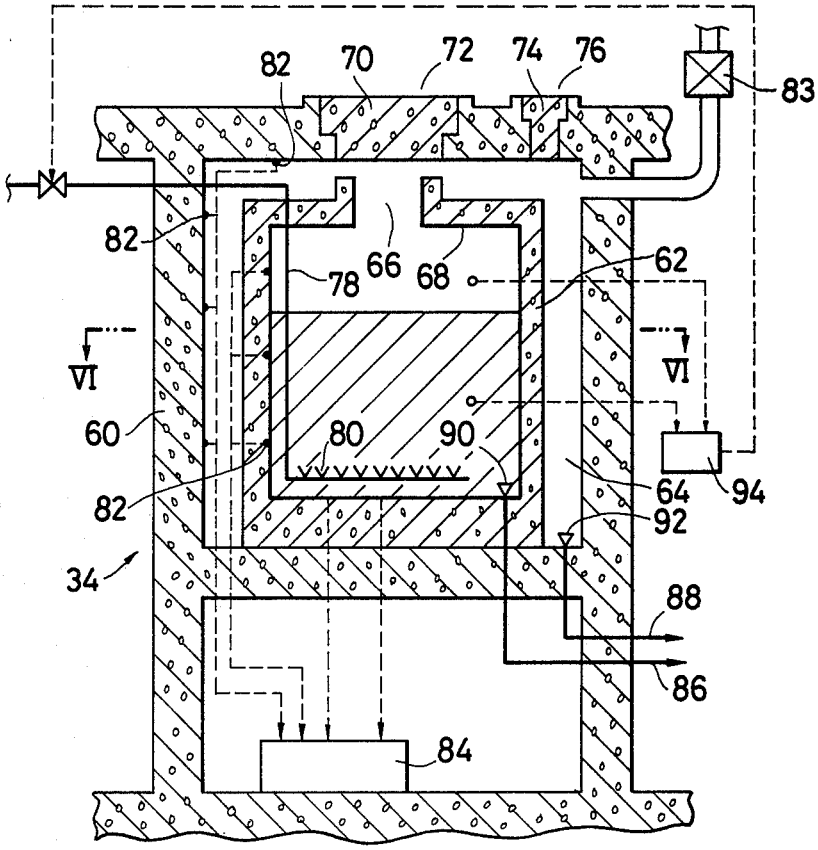
FIG. 5 is a sectional view of a pellet store vessel according to the present invention.

FIG. 5 is a view showing the longitudinal section of the store vessel 34 and FIG. 6 is a view showing the section taken along the line VI—VI in FIG. 5. The store vessel 34 comprises an outer wall 60 composed of concrete and an inner vessel 62 composed of concrete. The inner vessel 62 is disposed in a space 64 within the outer wall 60 on the bottom face of the space 64. A pellet filling and takeout opening 66 is formed on the upper portion of the inner vessel 62. A lining 68 is formed on the inner face of the inner vessel 62. An opening 72 for insertion of a plug 70 is formed on the floor face of the upper portion of the outer wall 60 at a position confronting the pellet filling and take-out opening 66. Furthermore, an opening 76 for insertion of a maintenance plug 74 is formed. The top ends of the openings 72 and 76 are located at positions higher than the level of the floor face of the upper portion so as to prevent the floor drain on the floor face of the upper portion from flowing into the openings 72 and 76.

A drying air feed pipe 78 is inserted into the inner vessel 62 and many jet holes of the drying air feed pipe 78 are opened to the bottom portion of the inner vessel 62. A waste gas treating device 82 is connected to the space 64.

A leaking liquid collecting pipe 82 is laid out on the wall face of the inner vessel 62 on the outside of the lining 68, on the inner face of the outer wall within the space 64 and on the floor face of the upper portion, and this pipe 82 is connected to a leakage detecting device 84. Drain withdrawal pipes 86 and 88 are opened to the bottom face of the inner vessel 64 and the bottom face of the space 64. These drain withdrawal pipes 86 and 88 are disposed for facilitating the maintenance and washing of the store vessel 34. Plugs 90 and 92 are attached to the drain withdrawal pipes 86 and 88.

When the pellets are packed in the inner vessel 62, the plug 70 is dismounted and the pellets being fed by the pellets transporting device 32 are filled in the inner vessel 62 through the opening 72 and the pellet filling and take-out opening 66. When a predetermined amount of pellets is packed in the inner vessel 62, feeding of the pellets is stopped and the plug is inserted into the opening 72, and other pellets transported by the pellet transporting device 32 are packed in another inner vessel.

Drying air is fed into the inner vessel 62 through the drying air feed pipe 78 and jet holes 80. Drying air passes through the pellets and flows into the space 64 from the inner vessel 62 while drying the pellets. This drying air is fed to the waste gas treating device 82 to remove radioactive substances from the drying air. The temperature, pressure and humidity in the inner vessel 62 are measured by an atmosphere detecting device 94, and the feed rate of drying air to the inner vessel 62 is controlled based on the measured values. Since the temperature, pressure and humidity in the inner vessel 62 are thus maintained at predetermined levels, deliquescence of pellets is not caused while they are stored in the inner vessel 62.

By adoption of a double structure including the outer wall 60 and the inner vessel 62 is the store vessel 34, it is possible to moderate the risk of intrusion of leaking water into the inner vessel 62 from the outer environment of the outer wall 60. Since the leaking liquid 82 is laid out on the wall faces of the inner vessel 62 and the outer wall 60, leakage of the liquid can be immediately detected. Moreover, because of the presence of the space 64, maintenance of each detecting system can be facilitated. Since there are disposed the leakage detecting device 84 and the atmosphere detecting device 94, properties of the pellets can be maintained at predetermined levels very easily and assuredly during the storage. Since both the outer wall 60 and inner vessel 62 are composed of concrete, shielding of radiations from the external region can be ensured. Since the lining 68 is formed on the inner face of the inner vessel 62, contamination of concrete from the inside end leakage of the liquid from the outside can be effectively prevented.

The cross-section of the inner vessel 62 may be circular.

Figure 7:
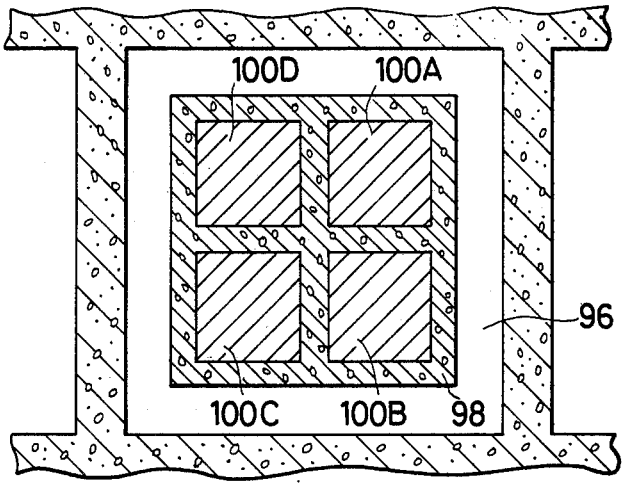
FIG. 7 is a sectional view illustrating another embodiment of the pellet store vessel according to the present invention.

Another embodiment of the present invention is illustrated in FIG. 7. In this embodiment, four pellet receiving portions 100A, 100B, 100C and 100D are formed in an inner vessel 98 arranged in a space 96. In this embodiment, effects attained in the embodiment shown in FIGS. 5 and 6 are similarly attained, and in addition, there can be attained an effect that even if properites of pellets in one pellet receiving portion 100A are changed, pellets in other pellet receiving portions 100B, 100C and 100D are not influenced at all.

Figure 8:
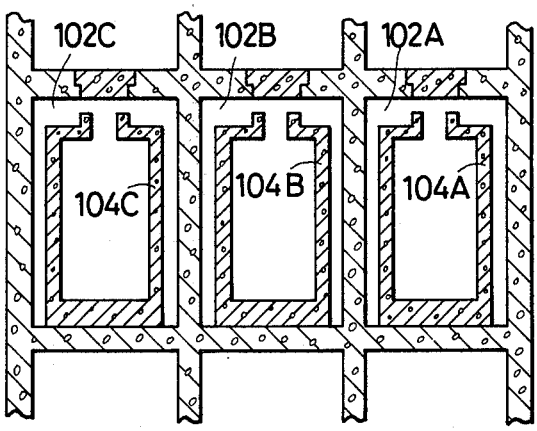
FIG. 8 is a sectional view illustrating still another embodiment of the pellet store according to the present invention.

Still another embodiment of the present invention is illustrated in FIG. 8.

In this embodiment, inner vessels 104A, 104B and 104C are disposed in spaces 102A, 102B and 102C, respectively. These inner vessels 104A, 104B and 104C are used for packing, storing and taking out pellets, and the operation cycles of these inner vessels are changed, whereby the equipment efficiency can be increased.

The pellet treating device 36 will now be described by reference to FIGS. 9 through 11.

Figure 9:
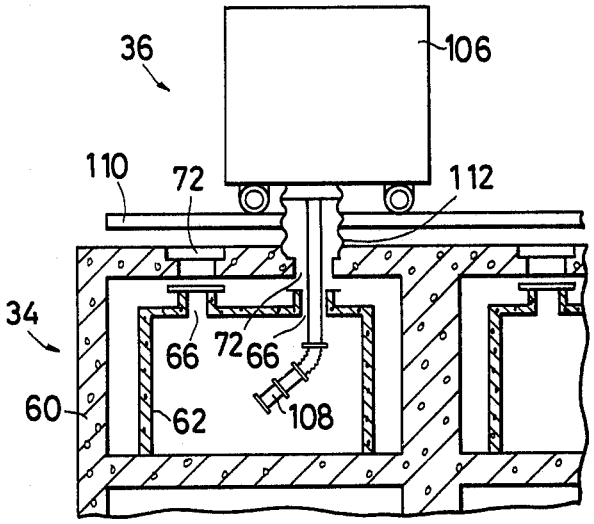
FIG. 9 is a sectional view illustrating the state where pellets are taken out from the pellet store vessel by using a pellet treating device according to the present invention.

Referring to FIG. 9, the pellet treating device 36 comprises a moving house 106 and a pellet take-out nozzle 108. The moving house 106 is allowed to move to just above the inner vessel 62 along a rail 110 arranged on the storage vessel 34. The pellet take-out nozzle 108 is inserted into the inner vessel 62 through the opening 72 on the outer wall 60 and the pellet filling and take-out opening 66 on the inner vessel 62. An air-tight sealing member 112 is disposed between the opening 72 on the outer wall 60 and the floor of the moving house 106 to prevent leakage of radiation. A television camera (not shown) is attached to the pellet take-out nozzle 108, and the pellet take-out nozzle 108 sucks up a predetermined amount of pellets uniformly from the entire surface in the inner vessel 62. The pellet take-out nozzle 108 is provided with rotating and lifting mechanisms and is arranged so that it can move freely.

Figure 10:
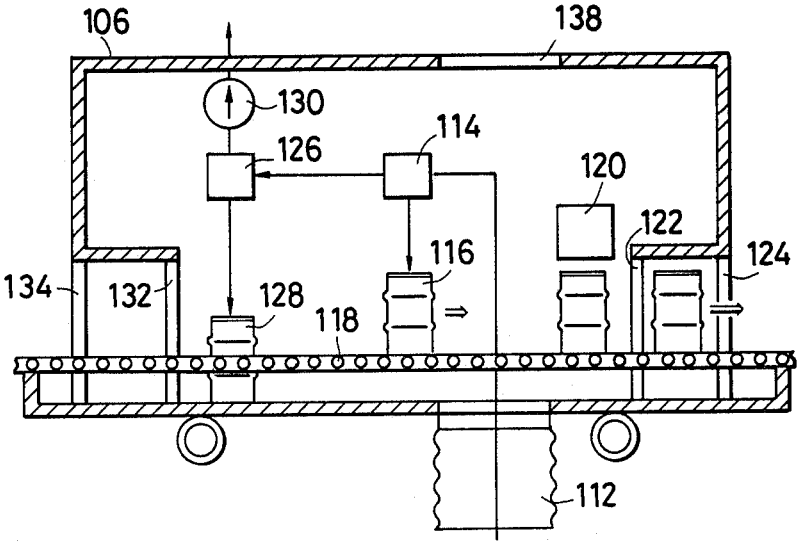
FIG. 10 is a sectional view illustrating the internal structure of a moving house of the pellet treating device and the flow of pellets.

As shown in FIG. 10, the pellets sucked up from the inner vessel 62 are introduced into a drum can 116 through a cyclone 114. The drum can 116 is placed on a truck (not shown) capable of moving the drum can 116 in the vertical direction. This truck is located on a roller conveyor 118, and a radiation detector (not shown) is mounted on the truck to detect the amount of pellets packed in the drum can 116. When the surface dose rate of the drum can 116 reaches a predetermined level, feeding of the pellets is stopped. After a predetermined amount of pellets has been packed in the drum can 116, the drum can 116 is fed to a capping device 120 by the roller conveyor 118. The drum can 116 is capped by the capping device 120 and discharged to the outside of the moving house 106 through double doors 122 and 124 of the moving house 106 by the roller conveyor 118. Then, the drum can 116 is fed to an asphalt solidifying device (not shown).

Air and powder are fed to a filter 126 in the cyclone 114, and the powder alone is filled in a drum can 128. The drum can 128 is placed on the floor face of the moving house 106 and it is not placed on the roller conveyor 118. When the drum can 128 is completely filled with the powder, the drum can 128 is delivered outside the moving house 106 and fed to the granulator 30 where the powder is pelletized. Air which has passed through the filter 126 is fed to an air conditioning equipment (not shown) by a blower 130.

Another double doors 132 and 134 are formed on the side wall of the moving house 106 at a position confronting the double doors 122 and 124. An empty drum can 116 is introduced into the moving house 106 through the double doors 132 and 134 by the belt conveyor 118. The empty drum can 116 is moved below the cyclone 114.

Figure 11:
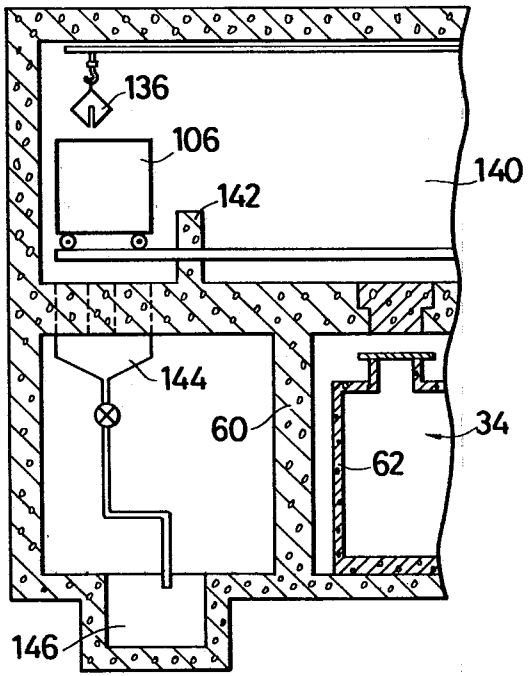
FIG. 11 is a sectional view illustrating a pellet treating device provided with means for washing the interiors of the pellet store vessel and moving house.

FIG. 11 is a view showing the section of the treating device provided with means for washing the store vessel 34 and the moving house 106.

In case of emergency, or when water leaks into the store vessel 34, the pellets in the inner vessel 62 are taken out from the inner vessel 62 by a bucket crane 136 and charged in the moving house 106 from an emergency pellet take-out opening 138 (shown in FIG. 10) in the moving house 106. In the movig house 106, the pellets are packed in the drum can 116 and the drum can 116 is capped. The packed drum can 106 is temporarily stored inside or outside the moving house 106 or in the vicinity of an asphalt solidifying equipment (not shown). The interior of the store vessel 34 is washed and dried.

The pressure in the moving house 106 is adjusted and the moving house 106 is arranged so that washing with warm water is possible. In order to prevent leakage of water in the store vessel 34, washing of the interior of the moving house 106 is not conducted on the store vessel 34, but the moving house 106 is moved beyond a wall disposed in the end portion of a loading area 140 and washing is carried out in this position. The washing water from the moving house is collected in a hopper 144, introduced into a tank 146 and then returned to the main process where the washing water is treated again.

A pellet storage control device disposed in the inner vessel will now be described by reference to FIGS. 12 through 14.

Figure 12:
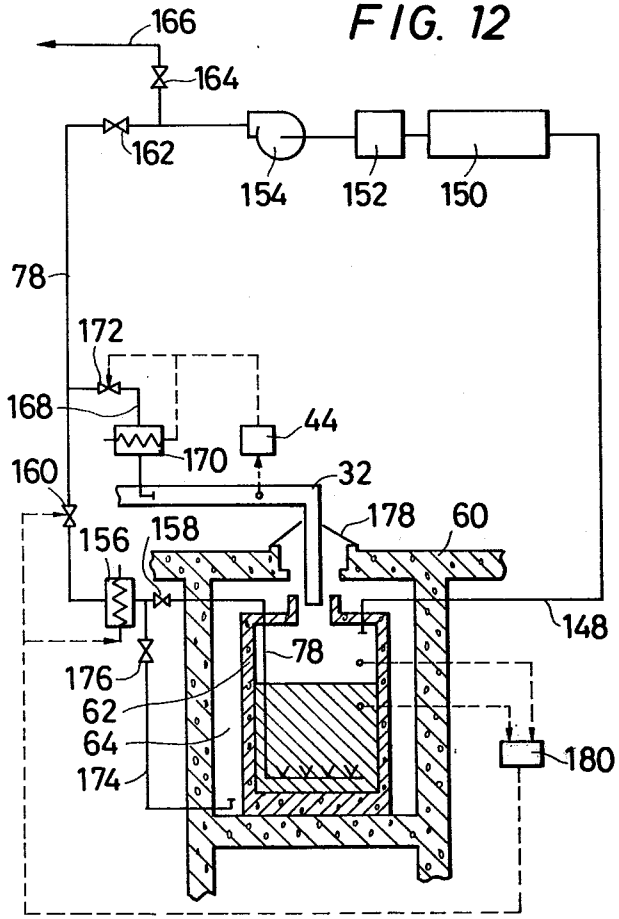
FIG. 12 is a block diagram illustrating a pellet storage control device in the state where pellets are being packed in the store vessel.

FIG. 12 illustrates the pellet storage control device in the state where pellets are being packed in the inner vessel 62 by the pellet transporting device 32. The pellet storage control device comprises a drying air supply pipe 78, an air discharge pipe 148, filter means 150, dehumidifying means 152 and a blower 154. As pointed out hereinbefore, one end of the drying air supply pipe 78 is opened to the bottom portion of the inner vessel 62, and the other end is connected to the blower 154 through a heater 156, a valve 158, a valve 160 and a valve 162. One end of the air discharge pipe 148 is opened to the upper portion of the inner vessel 62 and the other end is connected to the blower 154 through the filter means 150 and dehumidifying means 152. A pipe 166 provided with a valve 164 is disposed on the outlet side of the blower 154 and is connected to the drying air supply pipe 78. This pipe 166 is disposed for ventilation. One end of a drying air supply pipe 168 is opened to the interior of the pellet transporting device 32 and the other end is connected to the drying air supply pipe 78 through a heater 170 and a valve 172. One end of a drying air supply pipe 174 is opened to the interior of the space 64 and the other end is connected to the drying air supply pipe 78 through a valve 176. A sealing member 178 is disposed to provide a seal between the pellet transporting device 32 and the outer wall 60.

The operation of the device shown in FIG. 12 will now be described.

Air extruded from the blower 154 is heated to a predetermined temperature by the heaters 156 and 170 and is then fed into the inner vessel 62, the space 64 and the pellet transporting device 32. Drying air jetted in the inner vessel 62 rises through the pellets and flows into the air discharge pipe 148. This air is fed to the filter means 150. While the air rises in the inner vessel 62, the entrained powder is removed from the air by the filter means 150. The pressure, temperature and humidity in the inner vessel 62 are measured by an atmosphere detecting device 180. The opening degree of the valve 160 and the quantity of heat generated by the heater 156 are controlled based on the measured values, and the temperature and feed rate of drying air fed in the inner vessel are adjusted. The pressure, temperature and humidity are measured by the control device 44 shown in FIG. 2, and the quantity of heat generated by the heater 170 and the opening degree of the valve 172 are controlled based on the measured values.

Figure 13:
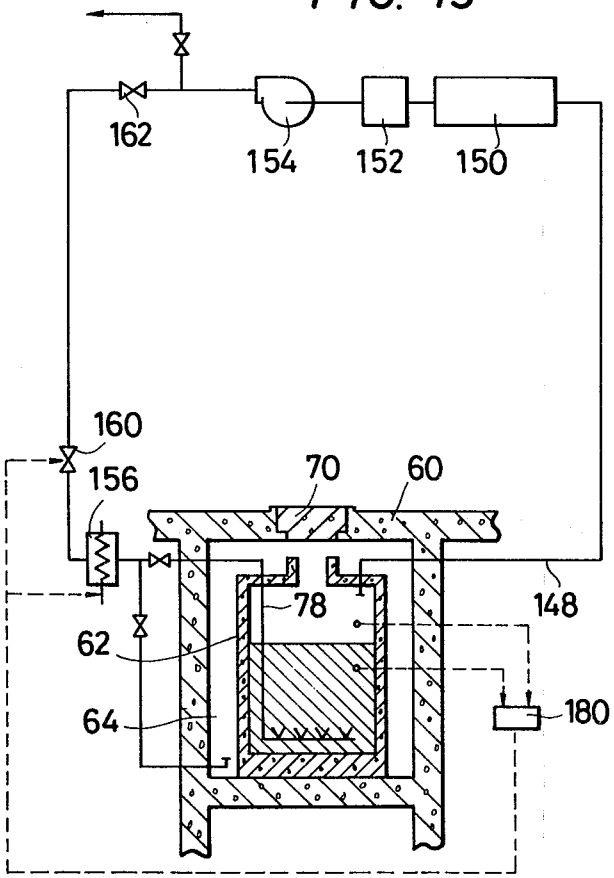
FIG. 13 is a block diagram illustrating the pellet storage control device in the state where pellets are stored in the store vessel.

FIG. 13 illustrates the state where packing of pellets in the inner vessel 62 has been completed and the pellets are stored in the inner vessel 62. The outer wall 60 is sealed by the plug 70. The blower 154 is driven to feed drying air into the inner vessel 62 and space 64 as described hereinbefore. The heater 156 and valve 160 are controlled by the atmosphere detecting device 180.

Figure 14:
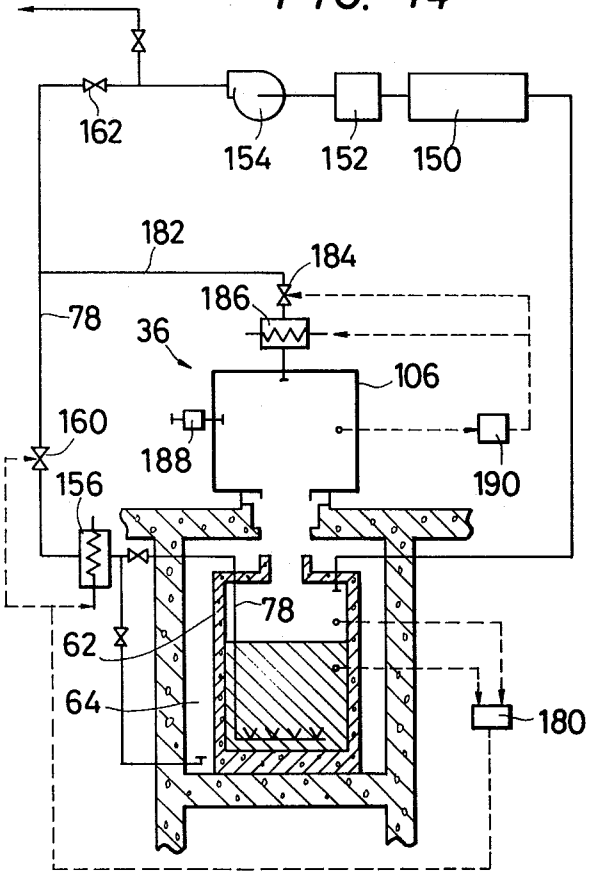
FIG. 14 is a block diagram illustrating the pellet storage control device in the state where pellets are being taken out from the store vessel.

FIG. 14 illustrates the state where pellets are taken out from the inner vessel 62 by the pellet treating device 36. One end of a drying air supply pipe 182 is connected to the drying air supply pipe 78 and the other end is opened to the moving house 106 through a valve 184 and a heater 186. The blower 154 is driven to feed drying air into the inner vessel 62 and the space 64 as described hereinbefore. The feeding of air is controlled by a pressure difference control device 188 so that a constant difference is maintained between the pressure outside the moving house 106 and the pressure inside the moving house 106. A detector 190 is disposed to detect the pressure, temperature and humidity in the moving house 106, and the heater 186 and valve 184 are controlled based on the measured values. Thus, the atmosphere in the moving house 106 is maintained under certain fixed conditions as well as the atmosphere in the inner vessel 62.

The present invention can be applied to the treatment of radioactive wastes discharged from a pressurized water reactor, a heavy water reactor, a nuclear fuel re-treatment equipment and other radioactive substance handling equipments as well as the treatment of radioactive wastes discharged from a water boiler type reactor.

The following effects can be attained by the present invention.

(1) Since a radioactive waste is first pelletized, temporarily stored for attenuation of the radioactivity and then solidified, the volume of the solid formed by solidification of a radioactive waste discharge from a radioactive substance handling equipment can be remarkably reduced.

(2) Since pellets do not contain a binder such as cement or asphalt, handling of the pellets is remarkably facilitated and the pellets can be conveniently applied to a final treatment for discharge of a radioactive waste to the natural world.

(3) Since a store vessel for temporarily storing pellets for attenuation of the radioactivity has a double structure, leakage of radiations can be completely prevented and the store vessel can be handled very safely.

(4) Since a pellet transporting device and a pellet treating device are disposed, the handling safety can be remarkably enhanced.

(5) Since conditions of air in the pellet transporting device, store vessel and pellet treating device are detected and the feeding of air is controlled based on the detection results, the properties of pellets can be maintained at predetermined levels during the steps of packing pellets, storing pellets and treating pellets, and deliquescence of pellets can be effectively prevented.

What is claimed is:

1. An apparatus for the treatment of radioactive wastes, which comprises a drying device for drying and powdering a radioactive waste discharged from a source of wet radioactive waste material, a granulator for pelletizing the powder of the radioactive waste, a storage means for temporarily storing a large mass of the initially formed pellets for a predetermined period for attenuating the radioactivity of the pellets, said storage means including shielding means for preventing leakage of radioactivity into the atmosphere surrounding said storage means, a pellet transporting means for transporting the initially formed pellets from the granulator to the storage means, with the amount of pellets being transported being controlled so that the surface dose of radioactivity of the transported pellets is maintained at a predetermined allowable level, a sealing vessel for packing a smaller mass of the radioactivity-attenuated pellets together with a binder, and a pellet treating device for taking out the smaller mass of the pellets from the storage means and transporting the smaller mass of pellets into the sealing vessel.

2. An apparatus for the treatment of radioactive wastes according to claim 1 wherein the storage means comprises a double wall structure including inner walls defining an inner vessel for storing the initially formed pellets, one of the inner walls providing a pellet filling and take-out opening for said inner vessel, and outer walls surrounding the inner walls defining said inner vessel and being arranged at a certain space from the inner walls, said outer walls having an opening at a position corresponding to the position of the pellet filling and take-out opening of the inner vessel; said double wall structure providing said shielding means for preventing leakage of radioactivity into the atmosphere surrounding the storage means.

3. An apparatus for the treatment of radioactive wastes according to claim 2 further comprising means for introducing drying air into the inner vessel and in the space between the inner walls defining the inner vessel and the outer walls.

4. An apparatus for the treatment of radioactive wastes according to claim 1 which further comprises means for feeding drying air into and through the storage means.

5. An apparatus for the treatment of radioactive wastes according to claim 3 further comprising means for discharging the drying air from the storage means, means for recycling the discharged air in a closed loop to said storage means, said closed loop including air treatment means for heating and effecting regeneration of said air by removing particles and moisture therefrom.

6. An apparatus for the treatment of radioactive wastes according to claim 5 wherein the closed loop includes an air heater, a pipe for feeding drying air into the storage means, means for feeding air under pressure into said pipe, pipe means for connecting said heater, said air feed pipe and said air feed means with said discharge means, and a valve for controlling the amount of air flowing in the closed loop.

7. An apparatus for the treatment of radioactive wastes according to claim 6 which further comprises means for detecting the temperature, pressure and humidity conditions of air in the storage means and means for controlling the feed rate of drying air supplied to said storage means according to the detected conditions.

8. An apparatus for the treatment of radioactive wastes according to claim 7 which further comprises means in communication with said closed loop for feeding drying air into the pellet transporting means when the initially formed pellets are transported from the granulator to the storage means by the pellet transporting means and means for detecting the temperature, pressure and humidity conditions of air in the pellet transporting means and controlling the feed rate of drying air to the pellet transporting means according to the detected conditions.

9. An apparatus for the treatment of radioactive wastes according to claim 7 which further comprises means for feeding drying air into the pellet treating device when the pellets are taken out from the storage means by the pellet treating device and means for detecting the temperature, pressure and humidity conditions of air in the pellet treating device and for controlling the feed rate of drying air to the pellet treating device according to the detected conditions.

10. An apparatus for the treatment of radioactive wastes according to claim 1 wherein the pellet treating device includes a nozzle for drawing pellets from the storage means and a movable vessel for receiving the pellets withdrawn by the nozzle.

11. An apparatus for the treatment of radioactive wastes according to claim 10, wherein the movable vessel for receiving the pellets contains a plurality of the sealing vessels into which the pellets are successively introduced, said sealing vessels comprising closable drums.

12. An apparatus for the treatment of radioactive wastes according to claim 1 further comprising control means for controlling the atmosphere inside of said storage means to prevent deliquescence of the pellets therein.

13. An apparatus for the treatment of radioactive wastes according to claim 12, wherein said pellet transporting means includes means for transporting the pellets individually one-by-one in separate containers to insure that the surface dose of radioactivity of the transported pellets is maintained at the allowable level.

14. A method for the treatment of radioactive wastes which comprises drying and powdering a radioactive waste discharged from a source of radioactive waste material, pelletizing the resulting powder, transporting the resulting pellets into a storage means, temporarily storing the pellets in the storage means for a predetermined period and preventing leakage of radioactivity from said storage means during said temporary storage, taking out the pellets from the storage means, packing the pellets in a sealing vessel and injecting a binder into the sealing vessel; the amount of pellets stored in the storing means being sufficient to supply a plurality of sealing vessels.

15. A method for the treatment of radioactive wastes according to claim 14 wherein the atmosphere in the storage means is kept dry by circulating dry air through the storage means whereby deliquescence of said pellets temperarily stored in said storage means is prevented.

16. A method for the treatment of radioactive wastes according to claim 14 or claim 15 wherein the atmosphere of a passage for transporting the pellets to the storage means is controlled by circulating dry air therethrough whereby deliquescence of the pellets within said passage is prevented.

* * * * *